US005331824A

United States Patent [19]

Miller et al.

[11] Patent Number: 5,331,824

[45] Date of Patent: Jul. 26, 1994

[54] REFRIGERATION APPARATUS AND METHOD OF REFRIGERATION

[75] Inventors: Jeremy P. Miller, Mortimer; Charles M. Monroe, High Wycombe; Mark S. Williams, Kingston-Upon-Thames, all of United Kingdom; Miles P. Drake, Allentown, Pa.

[73] Assignee: Air Products and Chemicals, Inc., Allentown, Pa.

[21] Appl. No.: 979,572

[22] Filed: Nov. 20, 1992

[30] Foreign Application Priority Data

Nov. 20, 1991 [GB] United Kingdom ..... 9124649.6
Oct. 24, 1992 [GB] United Kingdom ..... 9222381.7

[51] Int. Cl.[5] ..... F25B 1/00

[52] U.S. Cl. ..... 62/175; 62/184; 62/503

[58] Field of Search ..... 62/175, 181, 183, 184, 62/503, 332, 331, 333, 208, 209, DIG. 2

[56] References Cited

U.S. PATENT DOCUMENTS 3,067,590 12/1962 Wood, Jr. ..... 62/DIG. 2
3,077,088 2/1963 Japhet ..... 62/DIG. 2
3,078,689 2/1963 Japhet ..... 62/DIG. 2
4,123,919 11/1978 Fehlhaber ..... 62/503
4,233,817 11/1980 Toth ..... 62/175
4,732,007 3/1988 Dolan et al. ..... 62/79

FOREIGN PATENT DOCUMENTS 1216765 12/1970 United Kingdom .
2177786 1/1987 United Kingdom .
2223299 4/1990 United Kingdom .

*Primary Examiner*—Harry B. Tanner
*Attorney, Agent, or Firm*—James C. Simmons; William F. Marsh

[57] ABSTRACT

Supplementary cooling for a mechanical refrigeration plant using ammonia as a refrigerant is provided by placing a tube in the vapor space of a buffer vessel and introducing liquid nitrogen into the tube. Although ammonia solidifies at −78° C. and liquid nitrogen enters the tube at −196° C. no ammonia solidifies on the tube even after extended operation. The present invention also provides a method of refrigeration which comprises introducing liquid nitrogen into the heat exchanger of a refrigeration apparatus in accordance with the invention and condensing refrigerant therewith. Preferably, the refrigerant is selected from the group consisting of ammonia and fluorocarbon R22.

16 Claims, 4 Drawing Sheets

22'
21'
20'
19'
25'
24'
18'
11'
15'
13'
23'
14'
12'
10'
27
26
2'
1'
3'
17'
9'
8'
4'
5'
6'
7'

REFRIGERATION APPARATUS AND METHOD OF REFRIGERATION

This invention relates to a refrigeration apparatus and to a method of refrigeration.

Large commercial refrigeration units, for example for freezing meat and vegetables are generally cooled by mechanical refrigeration apparatus. Whilst such units are generally satisfactory problems frequently arise in the warmest part of summer when the refrigeration capacity of the mechanical refrigeration apparatus is inadequate to provide the desire refrigeration.

Various proposals have been made to reduce this problem. In particular, in UK-A-1 531 953 surplus refrigeration capacity during cool ambient conditions is used to freeze a eutectic mixture. During high refrigeration loads the mechanical refrigeration available is supplemented by condensing part of the warm gas returning from cooling duty in heat exchange with the eutectic mixture.

Whilst this arrangement copes adequately with brief warm periods it cannot cope with prolonged periods of high heat load since no more refrigeration is available after all the eutectic has melted and warmed to room temperature. Furthermore, if there is a compressor failure the entire inventory, worth perhaps several million pounds, may be lost as large compressors are normally made to special order and take several months to fabricate.

Various proposals have been made for using liquid nitrogen to supplement the refrigeration produced by the mechanical refrigeration unit. However, whilst this alternative may seem quite attractive there are a number of technical problems which have to be overcome. In particular, liquid nitrogen is supplied at a temperature of approximately −196° C. In contrast ammonia, the most commonly used commercial refrigerant freezes at approximately −78° C. at 1 bar absolute. In addition, most commonly used fluorocarbon refrigerants solidify at between −40° C. and −100° C. at 1 bar absolute. It will thus be appreciated that there is a serious risk of the refrigerant solidifying if liquid nitrogen is used to supplement refrigeration. By way of comparison it will be noted that thick layers of ice build up on the cooling coils of domestic refrigerators and have to be defrosted at regular intervals.

UK-A-2 177 786 discloses a refrigeration apparatus in which a refrigerant is compressed in a compressor and then passed through a condenser. The liquid and any residual vapour leaving the condenser is then condensed and sub-cooled in a sub-cooler in indirect heat exchange with liquid nitrogen before being expanded through an expansion valve en route to the evaporator. In practice, frozen refrigerant gradually builds up in the sub-cooler which has to be defrosted at regular intervals. In addition, if the compressor fails the whole refrigeration apparatus becomes inoperative.

We have discovered, totally unexpectedly, that if liquid nitrogen is introduced into a pipe which extends into gaseous ammonia the ammonia simply condenses and does not solidify on the pipe. In contrast, if the pipe is immersed in liquid ammonia the liquid ammonia rapidly solidifies and adheres to the pipe. The applicants can offer no coherent explanation of this behaviour since solidification did not occur even when sufficient liquid nitrogen was introduced into the pipe so that gaseous nitrogen at nearly −120° C. flowed out of the outlet! A similar effect was observed with fluorocarbon refrigerant R22.

According to one aspect of the present invention there is provided a refrigeration apparatus including a buffer vessel, a compressor for compressing gaseous refrigerant from said buffer vessel, a condenser for at least partially condensing refrigerant from said compressor, an expansion device for expanding fluid from said condenser, a line for carrying expanded fluid to said buffer vessel, an evaporator arranged to receive liquid refrigerant from said buffer vessel, and a pipe for returning at least part of the fluid from said evaporator to said buffer vessel, characterized in that said refrigeration apparatus further comprises a heat exchanger arranged to condense gaseous refrigerant from at least one of said evaporator and said buffer vessel and connected or connectable to a source of liquid nitrogen.

The absence of solid refrigerant means that the apparatus can be operated continuously and reliably for extended periods under high refrigeration loads without the need to defrost.

Advantageously, a pump is provided to deliver liquid from said buffer vessel to said evaporator, however it is conceivable that the evaporator circuit could operate on natural circulation.

It will be appreciated that the refrigeration apparatus described above will operate in the absence of the compressor, for example a new refrigeration plant awaiting delivery of a new compressor or an existing refrigeration plant awaiting a new compressor or repair of the existing compressor. It should be noted that, in contrast to the compressor, spare pump(s) to deliver the refrigerant to the evaporator are normally kept in stock at refrigeration plants and can be quickly and easily changed.

In large commercial plant the refrigeration apparatus is generally divided into a machine area and a cold store. The machine area generally comprises a plant room which houses the compressor, an expansion valve and the buffer vessel which hold a reserve of liquid refrigerant from the expansion valve and an open area which houses the condenser. One or more pumps are provided to deliver liquid refrigerant to banks of evaporators disposed in the cold store. The vapour from the evaporators is then returned to the buffer vessel in the machine area where it is mixed with vapour from the expansion valve and returned to the inlet of the compressor.

In one embodiment, the cryogenic fluid is brought into heat exchange with the gaseous refrigerant leaving the evaporator en route for the buffer vessel.

Thus, in this embodiment the heat exchanger is disposed between said evaporator and said buffer vessel.

In another embodiment the heat exchanger is arranged to receive warm refrigerant vapours from said buffer vessel and to return condensed and/or condensed and gaseous refrigerant thereto.

Advantageously, the heat exchanger in this embodiment is disposed above said buffer vessel.

In a most preferred embodiment the heat exchanger is situated in the vapour space in the buffer vessel.

Conveniently, the heat exchanger comprises a tube which extends through the wall of said buffer vessel.

Preferably, said tube has an inlet and an outlet adjacent said inlet.

Advantageously, said tube is of generally "U" shape and the inlet and outlet of said tube are attached to a common plate. This embodiment has the advantage that only a single hole need be cut in an existing buffer vessel in order to fit a heat exchanger. Indeed, in many existing buffer vessels covered flanges are already present. In these cases the flange covers can simply be removed and the heat exchanger installed with little difficulty.

Advantageously, said apparatus includes a control system comprising a first sensor responsive to the pressure in said buffer vessel and operative to enable the flow of cryogenic fluid to said heat exchanger.

Preferably, said control system also comprises a second sensor responsive to the temperature (or flowrate) at or adjacent the outlet of said heat exchanger to control the flow of cryogenic fluid to said heat exchanger. Recent work suggests that the second sensor may be responsive to the temperature approximately midway between the inlet and outlet of the heat exchanger.

Under normal conditions the pressure and/or temperature in said buffer vessel will be such that no cryogenic fluid is used. However, should the refrigeration load increase, for example due to a hot day or a large input of warm material into the cold room or the compressor fail the first sensor will enable the flow of cryogenic fluid to the apparatus. The second sensor then takes over to limit the volume of liquid nitrogen used so that the outlet temperature is at or above 5° C. colder than the condensation temperature of the refrigerant.

Preferably, said compressor comprises at least two stages separated by an intercooler, and means are provided to enable gaseous nitrogen from said heat exchanger to cool refrigerant passing between said stages.

Advantageously, said compressor comprises two stages, means are provided for condensing compressed refrigerant from said second stage and expanding said condensed refrigerant and using the refrigeration generated thereby to cool refrigerant leaving said first stage, characterized in that means are provided to enable gaseous nitrogen from said heat exchanger to subcool said condensed compressed refrigerant from said second stage.

Preferably, said refrigeration apparatus includes means to enable gaseous nitrogen from said heat exchanger to sub-cool condensed liquid upstream or downstream of said expansion device.

The present invention also provides a method of refrigeration, characterized in that it comprises the step of introducing liquid nitrogen into the heat exchanger of a refrigeration apparatus in accordance with the invention and cooling refrigerant therewith.

Preferably the refrigerant is selected from the group consisting of ammonia, R22, R12, R502, R134A.

For a better understanding of the present invention and to show how the same may be carried into effect reference will now be made, by way of example, to the accompanying drawings, in which.

Figure 1:
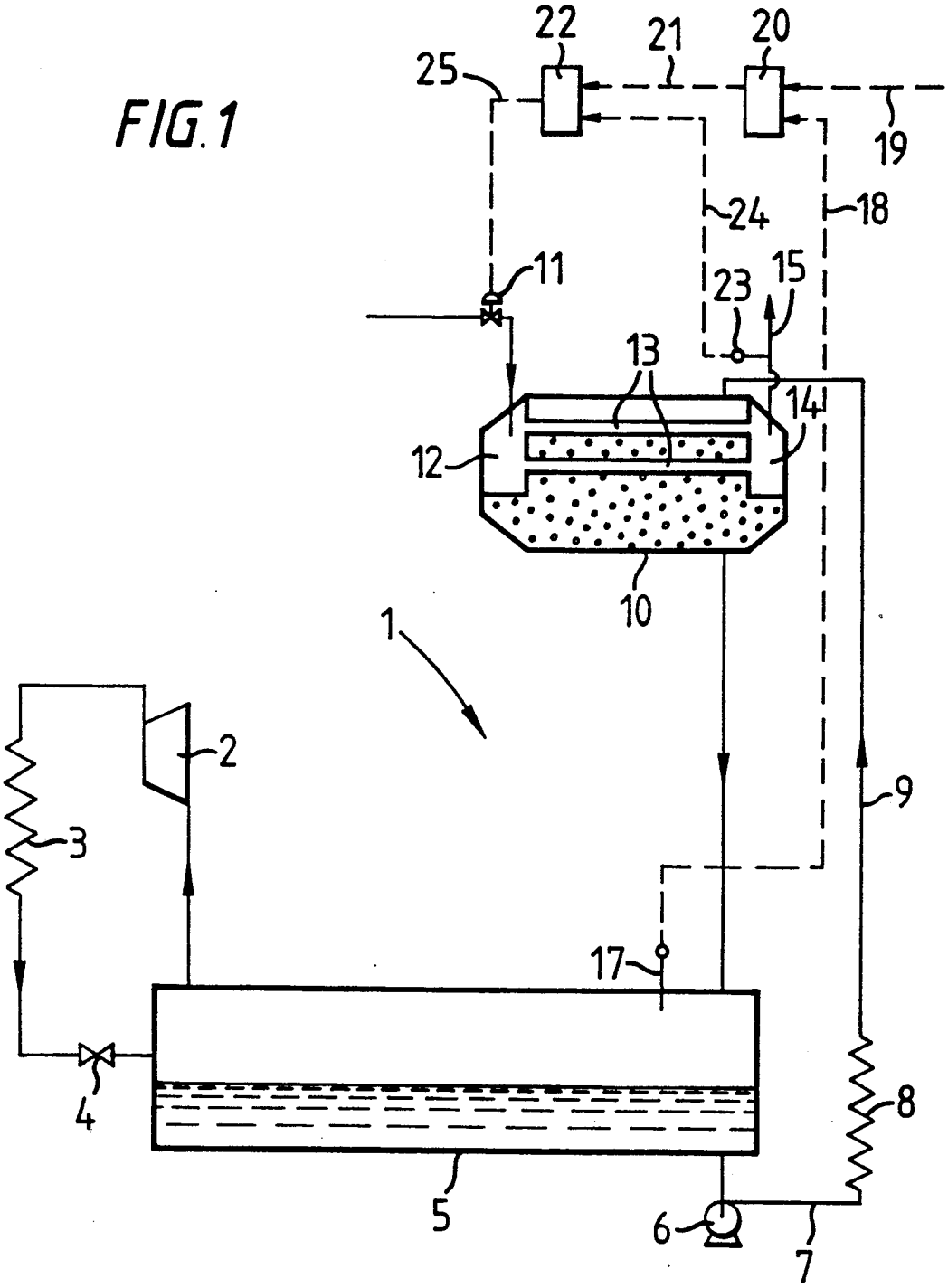
FIG. 1 is a schematic flow sheet of one embodiment of a refrigeration apparatus in accordance with the invention.

Referring to FIG. 1 of the drawings there is shown a refrigeration apparatus which is generally identified by reference numeral 1. The refrigeration apparatus comprises a compressor 2 which is adapted to compress gaseous refrigerant to an elevated pressure. During compression the gas becomes hot and the hot compressed gas is then cooled and condensed in a battery of condensers 3. The condensed refrigerant is then expanded through a J-T valve 4 and the liquid and any vapour passed into a buffer vessel 5 which is well insulated.

In a large refrigeration apparatus such as is being described the compressor 2, condenser 3, J-T valve 4 and buffer vessel 5 are normally disposed in a machine area. The compressor 2, J-T valve 4 and buffer vessel 5 are usually housed in a separate building whilst the condenser 3 is normally left outside.

Liquid from the buffer vessel 5 is pumped by pump 6 through pipe 7 to a bank of evaporators 8 which are disposed in and around a cold store or processing area remote from the machinery area.

The vapour leaves the evaporator 8 through pipe 9 and passes through a heat exchanger 10 where it is brought into indirect heat exchange with liquid nitrogen. In particular, liquid nitrogen is passed through control valve 11 into a header 12. It then passes through tubes 13 which it leaves via header 14 and outlet pipe 15.

In normal use, compressor 2 provides all the refrigeration demands of the refrigeration apparatus 1 and liquid nitrogen is not required.

If the refrigeration capacity of the compressor is inadequate, for example on a very hot summer's day, the pressure in buffer vessel 5 will rise. A pressure sensor 17, which continually monitors the pressure in the buffer vessel 5, sends an increased signal along line 18 which is compared with a set signal from line 19.

If the signal on line 18 is greater than the set signal on line 19 the comparator 20 transmits a signal which is a function of the difference between the signals along line 21 to comparator 22 which also receives an input from a temperature sensor 23 in outlet pipe 15 via line 24.

The comparator 22 generates a signal which is a function of the difference in the signals on lines 21 and 24 and transmits said signals to control valve 11 which opens to admit liquid nitrogen to flow into the heat exchanger 10 via header 12.

As the liquid nitrogen passes through the tubes it evaporates and condenses the refrigerant from the evaporator 8 and is itself warmed. The temperatures of the exiting gas is measured by temperature sensor It will be appreciated that as the compressor 2 becomes progressively overloaded more liquid nitrogen is admitted to the heat exchanger 10. Should the compressor 2 fail then the heat exchanger 10 is sized so that the entire refrigeration duty can be taken over by the supply of liquid nitrogen.

Although only a single pump 6 has been shown, a battery of some 6 to 10 pumps arranged in parallel serving separate batteries of evaporators are normally used. Thus, the failure of a single pump is rarely serious. Furthermore, standby pumps are normally installed and can quickly be brought on line whilst the defective pump is replaced. In trials using ammonia as refrigerant no solids could be seen inside the heat exchanger 10 which was provided with a small observation port.

Figure 2:
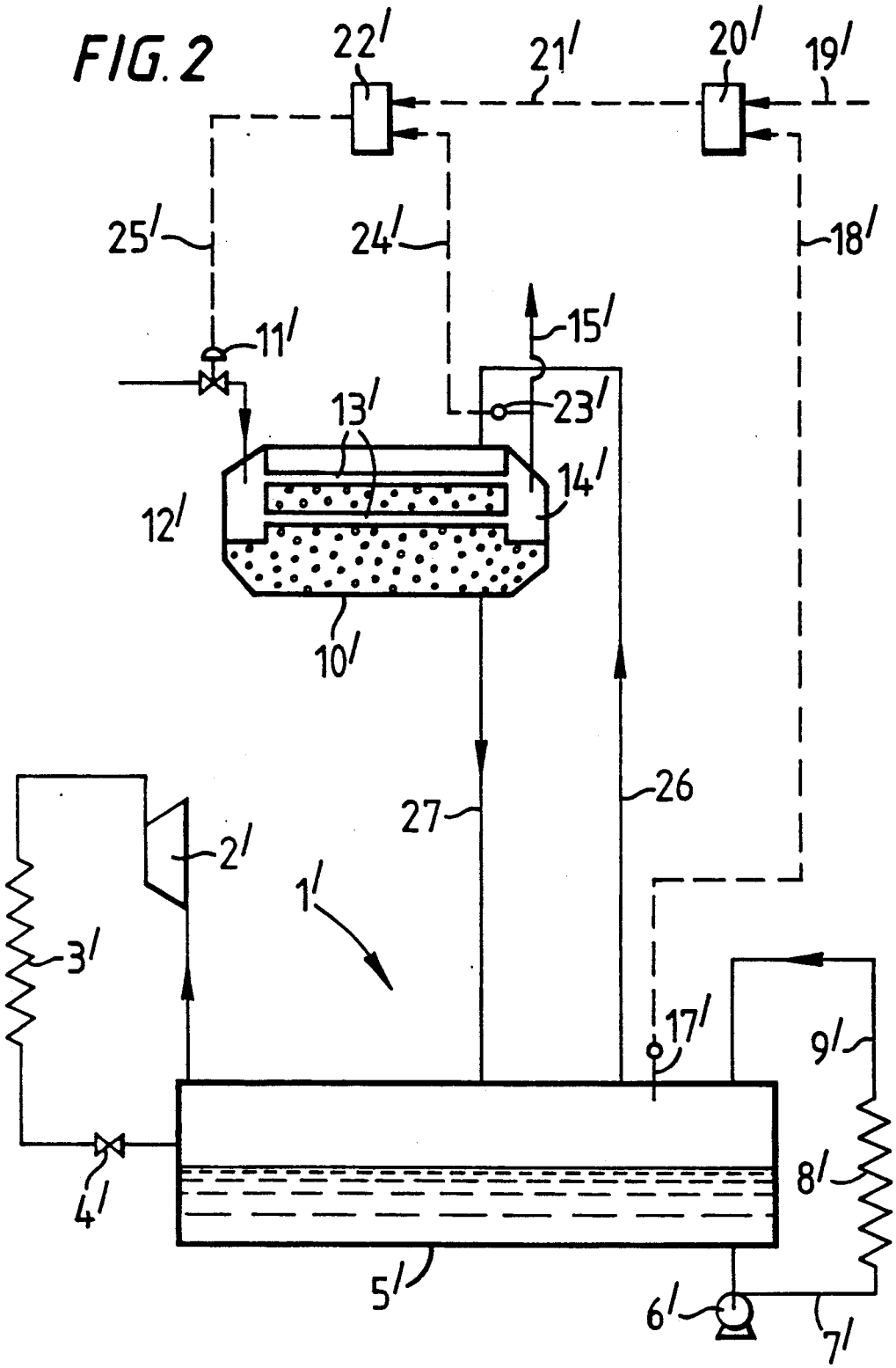
FIG. 2 is a schematic flow sheet of a second embodiment of a refrigeration apparatus in accordance with the invention.

The refrigeration apparatus shown in FIG. 2 is generally similar to the refrigeration apparatus shown in FIG. 1 and parts having similar functions have been identified by the same reference numerals with the addition of an apostrophe.

The essential difference with this embodiment is that instead of the heat exchanger 10' being placed between the downstream end of the evaporator 8' and the buffer vessel 5' it is disposed above the buffer vessel 5' and is connected thereto by large diameter pipes 26 and 27.

In normal use the large diameter pipes 26 and 27 are merely filled with gaseous refrigerant. However, when liquid nitrogen is admitted to the heat exchanger 10' cold and condensed refrigerant flows downwardly through pipe 27 into the buffer vessel 5' whilst the warmer, lighter refrigerant flows upwardly from the buffer vessel 5' through pipe 26, thus creating a thermo-siphon.

If desired, the thermo-siphon arrangement shown in FIG. 2 could be supplemented by a pump for delivering condensate through pipe 27 to buffer vessel 5'. With such a pump the heat exchanger 10' can be positioned above, below or at the same level as the buffer vessel 5'.

It will be appreciated that the invention can also be used for uprating the performance of an existing refrigeration apparatus which would otherwise require a larger or auxiliary compressor.

Figure 3:
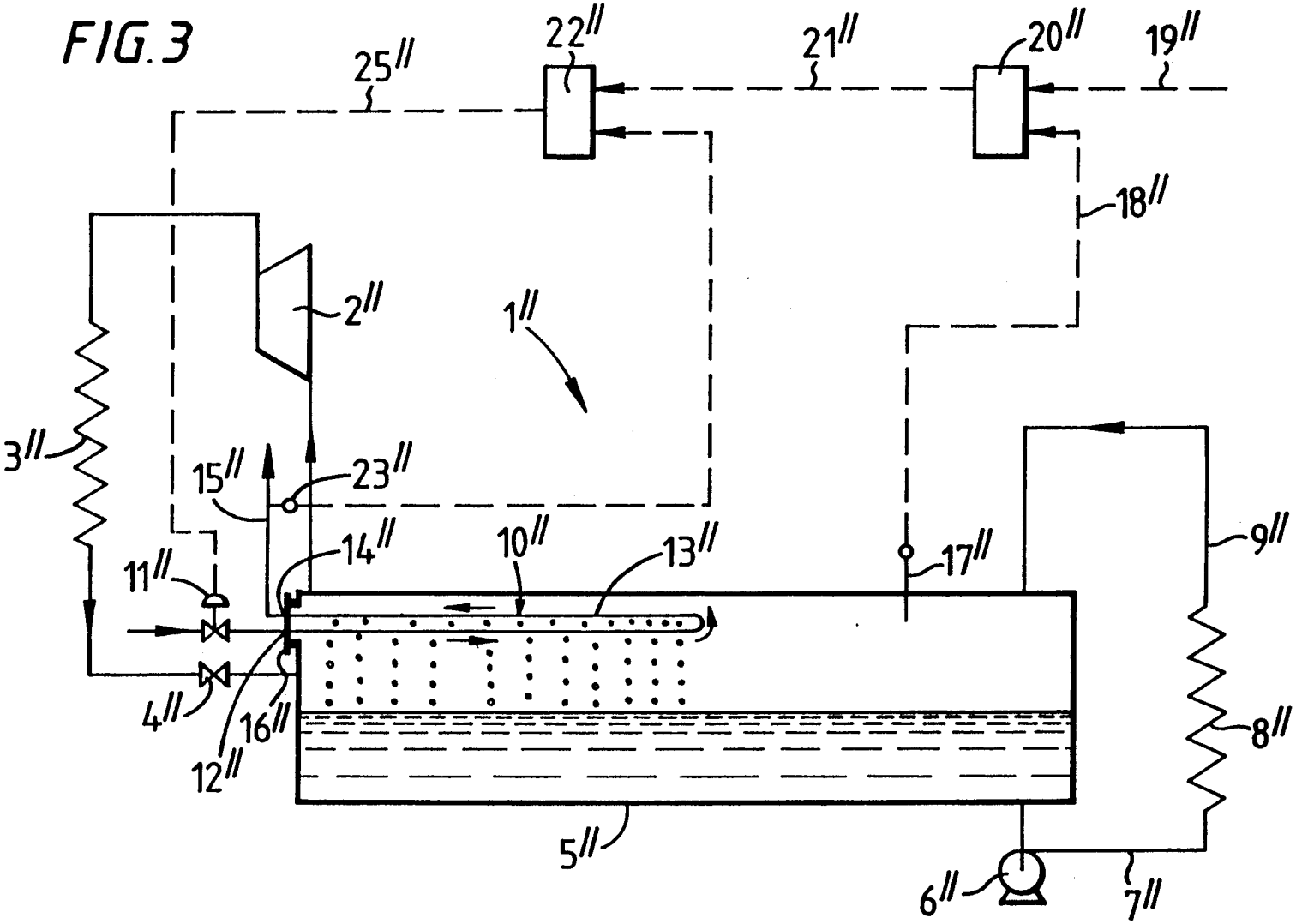
FIG. 3 is a schematic flow sheet of a third embodiment of a refrigeration apparatus in accordance with the invention.

Turning now to FIG. 3, there is shown a third embodiment. Parts having similar functions to parts shown in FIGS. 1 and 2 have been identified by the same reference numerals as used in FIGS. 1 or 2 but with the addition of two apostrophes.

In this embodiment the heat exchanger 10'' simply comprises a 'U' shape tube of 12.5 mm internal diameter copper tube. The tube 13'' has an inlet 12'' and an outlet 14'' which are welded onto a plate 16'' which is bolted onto an existing flange on the buffer vessel 5''.

During a 10 hour trial on a plant using ammonia as refrigerant and introducing amounts of liquid nitrogen into the inlet 12'' varying from a trickle to a flood sufficient for liquid nitrogen to pour out of the outlet 14'' no solid ammonia was observed on the surface of the tube 13''. However, a continuous rain of droplets of condensed ammonia was observed through an observation port fitted in the side of the buffer vessel 5''.

In commercial practice the temperature of the liquid ammonia in the buffer vessel is typically maintained at about −35° C. Accordingly, the temperature of the nitrogen leaving the heat exchanger will typically be about −40° C. There is thus a small amount of refrigeration still available in the nitrogen leaving the heat exchanger.

Figure 4:
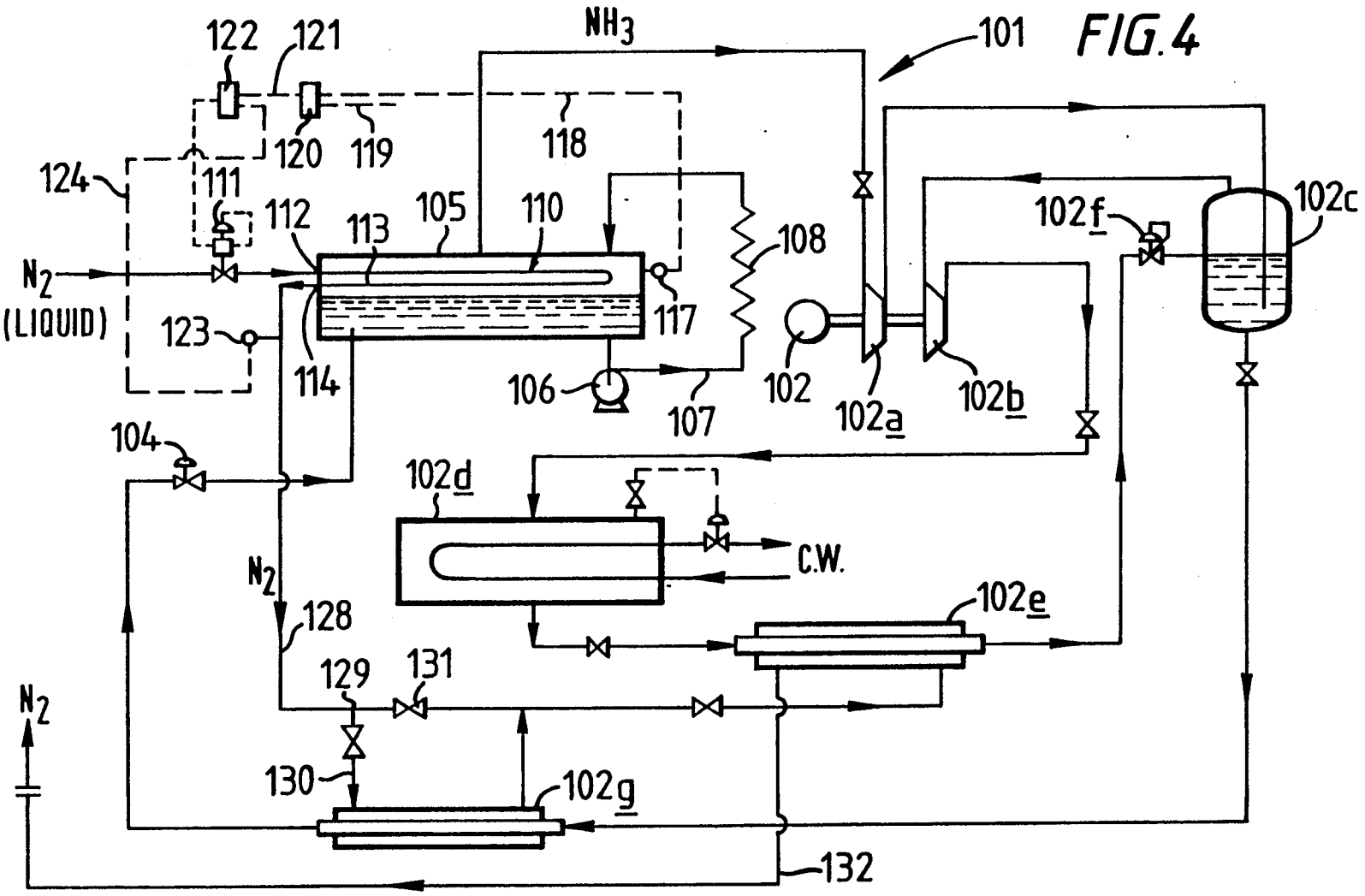
FIG. 4 is a flow sheet of a fourth embodiment of a refrigeration apparatus in accordance with the invention.

FIG. 4 shows a flowsheet of a commercial refrigeration apparatus provided with liquid nitrogen back-up. The refrigeration apparatus, which is generally identified by reference numeral 101 comprises a two stage compressor 102 comprising a first stage **102*a* and a second stage 102*b* which are arranged to compress gaseous ammonia to an elevated pressure. In particular, gaseous ammonia from a buffer vessel 105 is compressed to an intermediate pressure in first stage 102*a*. The hot compressed gas leaving the first stage 102*a* is then bubbled through liquid ammonia in the lower portion of an interstage cooler 102*c*. Part of the ammonia condenses whilst the gaseous portion leaves the top of the interstage cooler 102*c* and enters the second stage 102*b* of the compressor 102**.

The hot compressed gas leaving the second stage **102*b* is condensed in water cooled condenser 102*d* and sub-cooled in sub-cooler 102*e* before being let down across valve 102*f*. The liquid refrigerant leaves the bottom of the interstage cooler 102*c* and is sub-cooled in sub-cooler 102*g*, throttled through J-T valve 104 and introduced into buffer vessel 105**.

Liquid from the buffer vessel 105 is pumped by pump 106 through pipe 107 to a bank of evaporators 108 which are disposed in and around a cold store. The vapour from the evaporators 108 is then returned to the buffer vessel 105.

In normal operation the sub-coolers **102*e* and 102*g*** are not operational.

In times of excessive refrigeration load the temperature and pressure in the buffer vessel 105 increase. The pressure in the buffer vessel 105 is monitored by a pressure sensor 117 which transmits a signal indicative of the pressure along line 118 to a comparator 120 where it is compared with a set signal on line 119.

If the signal on line 118 is greater than the set signal on line 119 comparator 120 transmits a signal which is a function of the difference between the signals along line 121 to a comparator 122 which also receives an input from temperature sensor 123 at the outlet of the tube 113 via line 124.

The comparator 122 generates a signal which is a function of the difference between the signals on lines 121 and 124 and transmits said signal to control valve 111 which opens in response to the magnitude of said signal to admit liquid nitrogen to flow into the heat exchanger 110 via inlet 112.

The valve 111 admits sufficient liquid nitrogen to maintain the refrigerant in the buffer vessel 105 at the desired operating temperature of −50° C. The nitrogen leaves the outlet 114 of the heat exchanger 110 at approximately −55°0 C. and passes through a line 128 to a junction 129. Part of the nitrogen is diverted via pipe 130 through sub-cooler **102*g* whilst the balance is expanded fractionally across valve 131 and recombined with exhaust from the sub-cooler 102*g*. The recombined steam is then passed through sub-cooler 102*e* before being exhausted to atmosphere via pipe 132**.

It will be appreciated that with this arrangement the low grade refrigeration available in the nitrogen at the outlet 114 of the heat exchanger 110 is used both to sub-cool the condensed refrigerant from the compressor 102 and to supplement the interstage cooling of the compressor. This later usage is particularly important since effective interstage cooling renders the overall compression closer to isothermal compression and this reduces the overall work required to compress the refrigerant.

Whilst the heat exchangers in the preferred embodiments have been described as a single U-shaped tube it is envisaged that heat exchangers comprising a multiplicity of U-shaped tubes arranged in parallel could also be used.

It should be noted that the present invention, at least in its preferred forms, has considerable technical and economic significance. In particular, instead of a complicated heat transfer device, a simple U-tube heat exchanger can be inserted in a buffer vessel via a flange which may already be in existence. Liquid nitrogen can be fed directly into the heat exchanger for an extended period without any need to defrost. Accordingly, for minimal capital investment a conventional refrigeration plant with a stock valued at several million pounds sterling can be protected in the event of compressor failure. In addition, the additional refrigeration capacity offered by the liquid nitrogen can be used to provide adequate cooling during hot summer periods or to boost cooling if and when a relative warm load of goods, for example several hundred animal carcasses, arrive. The ability to cool quickly is extremely important in maintaining many food products in optimum condition and the present invention may be used for this purpose, particularly if additional evaporators are provided in the cold store to increase the heat transfer area.

It is anticipated that other refrigerants, such as chloro-fluorocarbons, halofluorocarbons and halo-fluoro-chlorocarbons may also be used in place of ammonia.

What is claimed is:

1. A refrigeration apparatus including a buffer vessel, a compressor for compressing gaseous refrigerant from said buffer vessel, a condenser for at least partially condensing refrigerant from said compressor, an expansion device for expanding fluid from said condenser, a line for carrying expanded fluid to said buffer vessel, an evaporator arranged to receive liquid refrigerant from said buffer vessel, and a pipe for returning at least part of the fluid from said evaporator to said buffer vessel, characterized in that said refrigeration apparatus further comprises a heat exchanger arranged to condense gaseous refrigerant from at least one of said evaporator and said buffer vessel and connected or connectable to a source of liquid nitrogen.

2. A refrigeration apparatus as claimed in claim 1, characterized in that it includes a pump for delivering liquid from said buffer vessel to said evaporator.

3. A refrigeration apparatus as claimed in claim 1, characterized in that said heat exchanger is disposed between said evaporator and said buffer vessel.

4. A refrigeration apparatus as claimed in claim 1, characterized in that said heat exchanger is arranged to receive warm refrigerant vapour from said buffer vessel and return condensed and/or condensed and gaseous refrigerant thereto.

5. A refrigerant apparatus as claimed in claim 4, wherein said heat exchanger is disposed above said buffer vessel.

6. A refrigerant apparatus as claimed in claim 1, characterized in that said heat exchanger is situated in the vapour space of said buffer vessel.

7. A refrigeration apparatus as claimed in claim 6, characterized in that said heat exchanger comprises a tube which extends through the wall of said buffer vessel.

8. A refrigeration apparatus as claimed in claim 7, characterized in that said tube has an inlet and an outlet adjacent said inlet.

9. A refrigeration apparatus as claimed in claim 8, characterized in that said tube is generally 'U' shape and the inlet and outlet of said tube are attached to a common plate.

10. A refrigeration apparatus as claimed in claim 1, including a control system including a first sensor responsive to the pressure or temperatures in said buffer vessel and operative to enable the flow of cryogenic fluid to said heat exchanger.

11. A refrigeration apparatus as claimed in claim 10, wherein said control system also comprises a second sensor responsive to the temperature at or adjacent the outlet of said heat exchanger to control the flow of cryogenic fluid to said heat exchanger.

12. A refrigeration apparatus as claimed in claim 1, wherein said compressor comprises at least two stages separated by an intercooler, and means are provided to enable gaseous nitrogen from said heat exchanger to cool refrigerant passing between said stages.

13. A refrigeration apparatus as claimed in claim 12, wherein said compressor comprises two stages, means are provided for condensing compressed refrigerant from said second stage and expanding said condensed refrigerant and using the refrigeration generated thereby to cool refrigerant leaving said first stage, characterized in that means are provided to enable gaseous nitrogen from said heat exchanger to sub-cool said condensed compressed refrigerant from said second stage.

14. A refrigeration apparatus as claimed in claim 12, including means to enable gaseous nitrogen from said heat exchanger to sub-cool condensed liquid upstream or downstream of said expansion device.

15. A method of refrigeration, characterized in that it comprises the step of introducing liquid nitrogen into the heat exchanger of a refrigeration apparatus as claimed in claim 1 and cooling refrigerant therewith.

16. A method according to claim 15, characterized in that said refrigerant is selected from the group consisting of ammonia, R22, R12, R502, R134A.

* * * * *